US011519142B2

(12) United States Patent
Fabry et al.

(10) Patent No.: US 11,519,142 B2
(45) Date of Patent: Dec. 6, 2022

(54) STRUCTURAL CABLE HAVING AN INNER HOUSING

(71) Applicant: SOLETANCHE FREYSSINET, Rueil Malmaison (FR)

(72) Inventors: Nicolas Fabry, Antony (FR); Matthieu Guesdon, Puteaux (FR); Ronan Solet, Cesson Sevigne (FR); Ihsan Aydin Alpman, Istanbul (TR); Müslüm Güzel, Ankara (TR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 722 days.

(21) Appl. No.: 16/482,799

(22) PCT Filed: Feb. 3, 2017

(86) PCT No.: PCT/IB2017/000214
§ 371 (c)(1),
(2) Date: Aug. 1, 2019

(87) PCT Pub. No.: WO2018/142174
PCT Pub. Date: Aug. 9, 2018

(65) Prior Publication Data

US 2020/0232171 A1 Jul. 23, 2020

(51) Int. Cl.
*E01D 19/16* (2006.01)
*E01D 19/14* (2006.01)
(Continued)

(52) U.S. Cl.
CPC ..... *E01D 19/16* (2013.01); *E01D 19/14* (2013.01); *D07B 1/148* (2013.01);
(Continued)

(58) Field of Classification Search
CPC ..... E01D 19/14; E01D 19/16; E01D 11/04; D07B 1/148; D07B 2201/2044;
(Continued)

(56) References Cited

U.S. PATENT DOCUMENTS 4,612,680 A 9/1986 Daiguji
5,461,743 A 10/1995 Stubler et al.
(Continued)

FOREIGN PATENT DOCUMENTS

CA 2983142 A1 4/2018
CN 201269444 Y 7/2009
(Continued)

OTHER PUBLICATIONS

Pictures of Shangdi Bridge at http://bbs.zol.com.cn/dcbbs/d22_38792.html.

*Primary Examiner* — Raymond W Addie
(74) *Attorney, Agent, or Firm* — Dentons US LLP

(57) ABSTRACT

A structural cable of a construction work. The structural cable including a bundle of load-bearing tendons, a sheath within which the bundle of tendons is located, a housing located within the sheath and fixed relative to the sheath, said housing defining a cavity, the bundle of tendons being at a distance from the housing and the cavity, the bundle of tendons being located outside the housing and the cavity, said cavity extending longitudinally relative to the sheath.

17 Claims, 4 Drawing Sheets

(51) Int. Cl.
*D07B 1/14* (2006.01)
*E01D 11/04* (2006.01)
*E04C 5/08* (2006.01)

(52) U.S. Cl.
CPC ..... *D07B 2201/2044* (2013.01); *D07B 2201/2087* (2013.01); *D07B 2201/2088* (2013.01); *D07B 2401/203* (2013.01); *D07B 2501/203* (2013.01); *E01D 11/04* (2013.01); *E04C 5/08* (2013.01)

(58) Field of Classification Search
CPC .... D07B 2201/2087; D07B 2201/2088; D07B 2401/203; D07B 2501/203; E04C 5/08
USPC ..... 14/22
See application file for complete search history.

(56) References Cited

U.S. PATENT DOCUMENTS

| | | | |
|---|---|---|---|
| 5,479,671 | A | 1/1996 | Stubler et al. |
| 7,631,384 | B2 | 12/2009 | Lecinq et al. |
| 7,779,499 | B2 | 8/2010 | Lecinq et al. |
| 2004/0037080 | A1 | 2/2004 | Luk et al. |
| 2006/0051035 | A1 | 3/2006 | Cavill |
| 2012/0058338 | A1 | 3/2012 | Fyfe et al. |
| 2012/0243225 | A1 | 9/2012 | Lee et al. |
| 2015/0113744 | A1 | 4/2015 | Stubler et al. |
| 2019/0363529 | A1* | 11/2019 | Kuster ..... F25D 21/08 |

FOREIGN PATENT DOCUMENTS

| | | | |
|---|---|---|---|
| CN | 202281125 | U | 6/2012 |
| CN | 202403211 | U | 8/2012 |
| CN | 204199176 | U | 3/2015 |
| DE | 2425866 | A1 | 12/1975 |
| DE | 3403611 | A1 | 8/1985 |
| DE | 35 29 001 | A1 | 2/1987 |
| DE | 199 06 374 | A1 | 9/2000 |
| FR | 2660332 | A1 | 10/1991 |
| GB | 2044726 | A | 10/1980 |
| KR | 100901165 | B1 | 6/2009 |
| KR | 1020130014092 | A | 2/2013 |
| RU | 2388866 | C2 | 4/2007 |
| WO | 88/09847 | A1 | 12/1988 |
| WO | 01/44680 | A1 | 6/2001 |
| WO | 2015/063511 | A1 | 5/2015 |
| WO | 2018020289 | † | 2/2018 |
| WO | 2018/072902 | A1 | 4/2018 |
| WO | 2018072902 | † | 4/2018 |
| WO | 2018130271 | † | 7/2018 |

* cited by examiner
† cited by third party

STRUCTURAL CABLE HAVING AN INNER HOUSING

CROSS-REFERENCE TO RELATED APPLICATIONS

This application is a National Stage application of International Application No. PCT/IB2017/000214 filed on Feb. 3, 2017, which is hereby incorporated by reference in its entirety as if fully set forth herein.

TECHNICAL FIELD

The present invention relates to structural cables used in the construction industry. It is applicable, in particular, to stay cables used for supporting, stiffening or stabilizing structures.

BACKGROUND

Stay cables are widely used to support suspended structures such as bridge decks or roofs. They can also be used to stabilize erected structures such as towers or masts.

A typical structure of a stay cable includes a bundle of tendons, for example wires or strands, housed in a collective plastic sheath. The sheath protects the metallic tendons of the bundle and provides a smooth appearance of the stay cable.

In certain cases, the sheath is in the form of an integral tube which extends from the lower anchoring point to the upper anchoring point of the stay cable. The tendons are threaded, usually one by one or small groups by small groups, into the sheath before anchoring them at both ends.

In other cases, the sheath is made of segments following each other along the cable. Each segment can be made of several sectors assembled around the bundle of tendons.

An object of the present invention is to propose a structural cable with enhanced functional capabilities.

SUMMARY

To that end, the invention relates to a structural cable of a construction work, the structural cable comprising:

- a bundle of load-bearing tendons,
- a sheath within which the bundle of tendons is located,
- a housing located within the sheath and fixed relative to the sheath, said housing defining a cavity, the bundle of tendons being at a distance from the housing and the cavity, the bundle of tendons being located outside the housing and the cavity, said cavity extending longitudinally relative to the sheath.

According to an aspect of the invention, the housing stretches over at least 10% of the length of the structural cable.

According to an aspect of the invention, the structural cable further comprises at least one functional component arranged in said cavity.

According to an aspect of the invention, the housing includes a concavity defining said cavity, said concavity being turned towards a longitudinal region of the sheath which includes openings.

According to an aspect of the invention, the at least one functional component includes a plurality of light-radiating modules configured to radiate light each arranged at least in part in said cavity so as to radiate light through at least one of said openings outwardly relative to the structural cable.

According to an aspect of the invention, the structural cable further comprises, for each opening among a plurality of openings, at least one reception element arranged in said opening, at least one light-radiating module being received within said reception element.

According to an aspect of the invention, the reception element is secured to the sheath, the reception element receiving at least one light-radiating module, the housing being nested in said reception element.

According to an aspect of the invention, the structural cable further comprises a cover element arranged on the outer surface of the sheath, the reception element further comprising a flange arranged between the cover element and the outer surface of the sheath to maintain the reception element in position.

According to an aspect of the invention, the cover element includes reception holes receiving fastening elements which fasten the housing and the cover element to the sheath.

According to an aspect of the invention, for at least one opening, the outer surface of the sheath defines a flat spot surrounding said opening, the cover element having a flat inner face whose dimensions correspond to the dimensions of the flat spot.

According to an aspect of the invention, the cover element has a curved outer face whose curvature matches the curvature of the outer surface of the sheath so that the curvature of the cross-section of the structural cable is substantially constant in the region of the opening.

According to an aspect of the invention, the housing is bonded to an inner surface of the sheath.

According to an aspect of the invention, the housing presents a tubular configuration over at least part of its length.

According to an aspect of the invention, the housing is integral with the sheath over at least part of the length of said housing.

According to an aspect of the invention, the housing comprises a plurality of longitudinal segments aligned with one another along the length of the structural cable.

According to an aspect of the invention, the housing is substantially continuous longitudinally relative to the sheath.

According to an aspect of the invention, the at least one functional component includes a lightning protection cable.

According to an aspect of the invention, the structural cable further comprises at least one lightning rod and at least one sacrificial module electrically connected to the lightning protection cable and respectively configured to attract lightning bolts and dissipate energy resulting from said lightning bolts.

According to an aspect of the invention, the at least one functional component comprises a fluid put in circulation in the housing, said fluid being configured to carry out a thermal function of the structural cable.

According to an aspect of the invention, the at least one functional component comprises at least one damping module configured to dissipate vibrations the structural cable is destined to be subjected to.

BRIEF DESCRIPTION OF THE DRAWINGS

Other features and advantages of the structural cable disclosed herein will become apparent from the following description of non-limiting embodiments, with reference to the appended drawings, in which.

DETAILED DESCRIPTION

Figure 1:
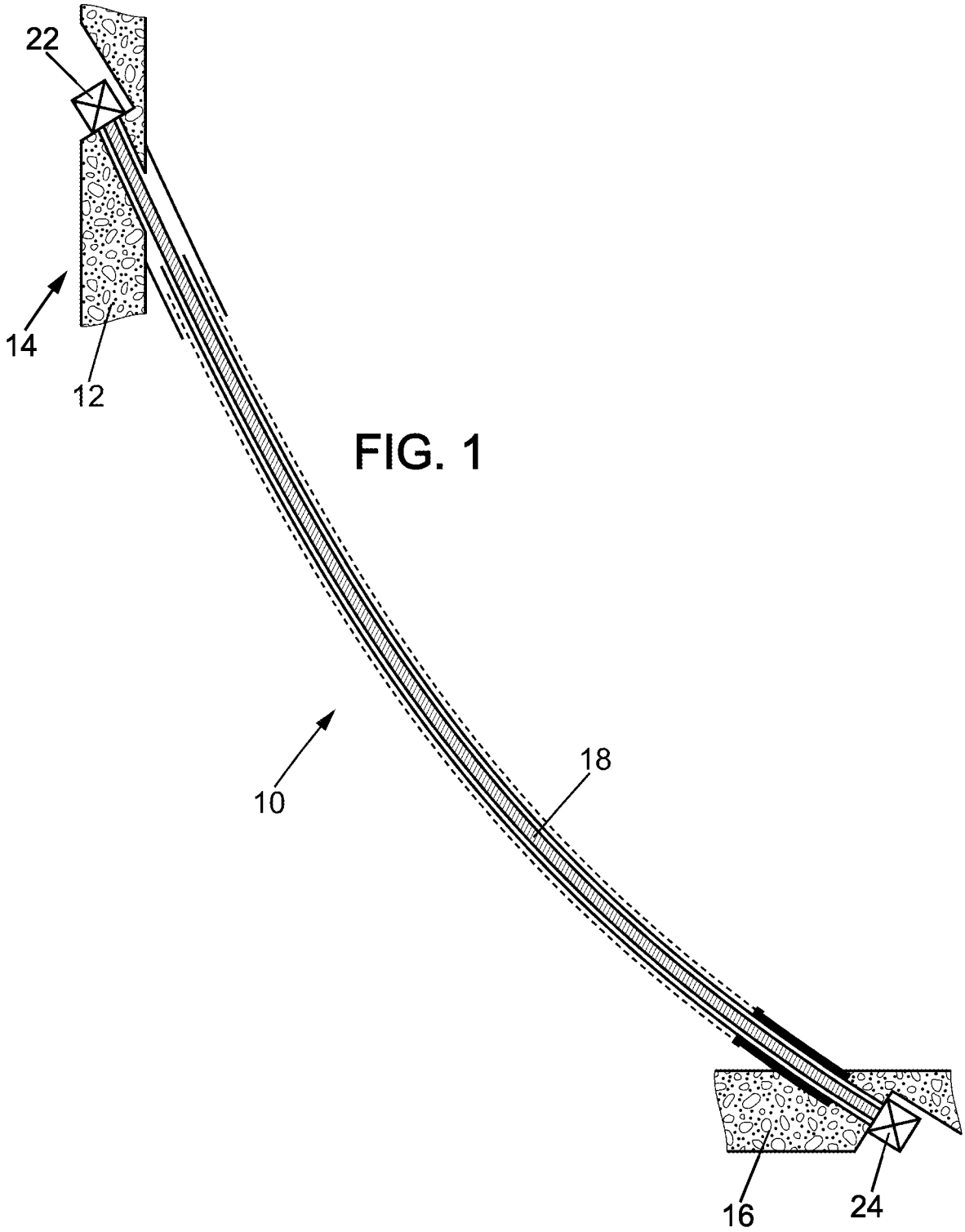
FIG. 1 illustrates a structural cable according to the invention.

FIG. 1 shows a structural cable 10 according to the invention, hereinafter cable 10. The cable 10 is preferentially a stay cable.

The cable 10 is configured to take up efforts applied to a structure 12 to which it is anchored. To that end, it extends between two parts 14, 16 of a construction work. The first part 14 is for instance at a higher position than the second part 16. For example, the first part 14 belongs to the structure 12, such as a tower, while the second part 16 belongs to a foundation to stabilize the structure. Alternatively, the first part 14 may belong to a pylon, while the second part 16 belongs to some structure suspended from the pylon.

The construction work typically includes a number of structural cables 10, only one of them being shown in FIG. 1.

Figure 2:
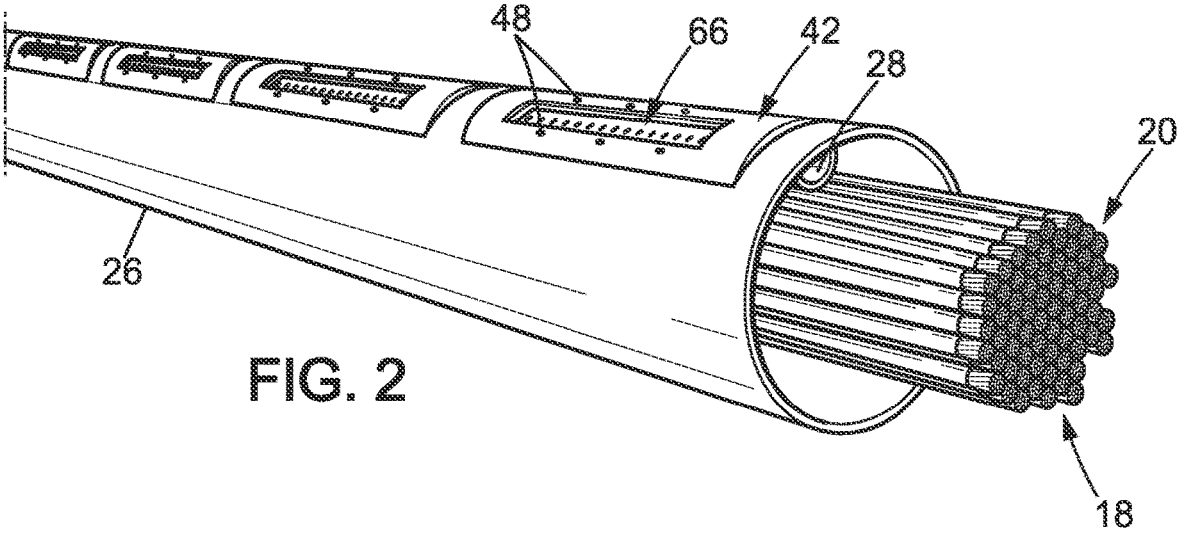
FIG. 2 illustrates the structure of the cable of FIG. 1.

The structural cable 10 comprises a load-bearing part 18 which comprises a bundle of tendons 20 disposed parallel to each other (FIG. 2). For example, the bundled tendons may be strands of the same type as used to pre-stress concrete structures. They are for instance made of steel. Each strand may optionally be protected by a substance such as grease or wax and/or individually contained in a respective plastic sheath (FIG. 2).

The bundle 20 forms the structural core of the cable 10, i.e. a main load-bearing component of the cable. As discussed below, the structural cable 10 may include additional load-bearing components, such as additional tendons, which are at a distance from the bundle 20.

The cable 10 may have a length of up to several hundred meters. The bundle 20 may include a few tens of tendons.

The tendons of the bundle 20 are anchored at both ends of the bundle using an upper anchoring device 22 mounted on the first part 14 of the construction work and a lower anchoring device 24 mounted on the second part 16 of the construction work. Between the two anchoring devices 22, 24, the bundle of tendons for instance follows a catenary curve due to the weight of the cable and the tensile force maintained by the anchoring devices. The anchoring devices 22, 24 are positioned on the first and second parts 14, 16 by taking into account the pre-calculated catenary curve of each cable 10.

In reference to FIG. 2, in addition to the load-bearing part 18, the cable 10 includes a sheath 26 within which the bundle 20 is received. The sheath forms a protective structure for the bundle.

Advantageously, the sheath 26 extends over more than 80% of the length of the bundle of tendons 20 between the anchoring devices 22, 24, or even more than 90% for long stay cables.

In the example illustrated in FIG. 1, the first end of the sheath 26 bears on a guide tube through which the bundle of tendons passes near the lower anchoring device 24, while the second end of the sheath 26 penetrates into another tube disposed on the first part 14 of the construction work, through which the upper end of the bundle of tendons passes to reach the upper anchoring device 22.

The sheath 26 has a cross-section which has any known shape.

For instance, this shape chosen among polygonal, elliptical or circular. Advantageously, as shown on the Figures, this cross-section is circular.

The shape of the cross-section may vary along the longitudinal direction of the cable. Preferably however, it does not.

The sheath 26 is for instance made of high density polyethylene (known as PEHD or HDPE).

Advantageously, at least part of the outer surface of the sheath 26 has a color adapted to reflect light. For instance, it is thus white. Additionally or alternatively, at least the outer surface of the sheath 26 is resistant to ultraviolet rays. This may be the result of a surface treatment and/or of a specific composition of the material of the sheath itself over at least part of its thickness.

As the outer surface of the sheath 26 is destined to be in contact with the surrounding environment, it advantageously presents a surface treatment and/or structure destined to increase its resistance to the combined effects of rain and wind. For instance, the outer surface of the second sheath 26 thus presents at least one helical rib, and advantageously a double helical rib, running helically along all or part of the length of the outer surface of the sheath 26 (not shown).

The sheath 26 may be an integral member between its extremities. Alternatively, the sheath 26 includes longitudinal segments which are assembled together in an aligned manner, for instance through any known process. For instance, each segment has a length of a few meters, for instance between 6 and 12 m.

Each segment may present itself in the form of an integral piece of tube. Alternatively, one or more segment includes a plurality of sector-shaped elements assembled together by their edges.

The bundle of tendons 20 is located within the sheath 26 at a distance from the inner surface of the sheath 26. Advantageously, the bundle occupies a central position within the sheath, i.e. the bundle 20 is substantially centered with respect to the cross-section of the sheath 26 (i.e. its cross-section transversely relative to the longitudinal direction of the cable).

Alternatively, the bundle 20 is off-center relative to the cross-section of the sheath 26.

The bundle of tendons is advantageously compacted as illustrated in FIG. 2 over at least part of its length, and advantageously at least over all its running part, i.e. its entire length optionally minus a few percents of its length or even less which are located in the vicinity of the anchoring devices 22, 24.

Preferably, the bundle of the tendons is compacted at least over the length of the cable 10 over which the housing 28 stretches.

By compacted, it is understood that the tendons of the bundle are maintained in contact with one another, for instance through the application of a centripetal force to the tendons.

In reference to FIG. 2 and following, the cable 10 according to the invention also includes a housing 28.

The housing 28 is located within the sheath 26. The housing 28 is fixed relative to the sheath 28.

The housing 28 defines a cavity 30. The housing 28 and the cavity 30 are at a distance from the bundle 20, the bundle 20 being located outside the cavity and the housing. In other words, the bundle 20 is not received in the cavity 30 or the housing 28.

The housing 28 and the cavity 30 stretch longitudinally along the bundle 20 and the structural cable 10. In other words, the housing 28 and the cavity 30 are arranged so as to run along the longitudinal direction of the cable 10.

For instance, the housing and the cavity extend over at least 10% of the length of the cable 10, and advantageously over more than 20%, 30%, 40% or 50%.

Advantageously, the housing 28 defines the cavity over substantially its entire length. Alternatively, the housing 28 defines the cavity over solely part of its length, preferably greater than 50% of its length.

Advantageously, the cavity 30 is continuous along its length. In other words, the cavity is not interrupted along the longitudinal direction of the cable. Alternatively, the cavity may be interrupted, for instance by one or more transverse element such as an inner wall. In such a scenario, the cavity may be seen as a group of adjacent cavities separated from one other. Advantageously, the transverse element(s) exhibit openings, whereby pieces of equipment may be laid out in continuous fashion in the cavity regardless of the transverse elements, and/or so that the various cavities are in fluid communication with one another.

Advantageously, the cross-section of the cavity with respect to the longitudinal direction of the cable has a substantially constant shape along this longitudinal direction.

The exact shape of this cross-section is discussed below, in reference to the various embodiments of the housing 28.

Advantageously, the cross-section of the housing 28 transversely relative to the cable defines a single cavity at a given location along the housing 28. In other words, this cross-section defines one cavity and one only, as opposed to a plurality of cavities which may for instance be separated by a component of the housing or added to the housing such as a wall.

Advantageously, the housing 28 comprises a plurality of longitudinal segments which are aligned with one another along the cable 10.

For instance, each segment stretches over several meters, for instance six or more meters. For instance, each segment is associated to a segment of the sheath, and has substantially the same length. For instance, each segment is arranged in the corresponding sheath segment so as to have extremities which are located at a same position as that of the sheath segment.

Two consecutive segments of the housing are for instance connected to one other. For instance, they are thus interlocked. For instance, one end of a given segment is inserted in the adjacent end of the consecutive segments, which exhibits an appropriate configuration to that end.

Alternatively or in parallel, two consecutive segments are separated by a clearance. This clearance is for instance smaller than 1 cm.

In general, advantageously, the longitudinal interruptions of the housing 28 are minimal. Advantageously, the housing is substantially continuous over its length.

In some embodiments, the housing may be an integral member over its entire length.

It should be noted that the cable 10 may include a plurality of housings 28 which are at a distance from each other, either longitudinally along the direction of the cable 10, and/or circumferentially within the sheath 26.

The housing 28 is advantageously made of polyethylene, such as PEHD.

The housing 28 may be made of the same material as the sheath 26. Alternatively, the housing 28 is made of a material which differs from that of the sheath 26.

In the context of the invention, the cavity 30 is advantageously destined to receive at least one functional component of the cable 10, which is detailed below.

As indicated above, the housing 28 and the cavity 30 may present different configurations, in particular in terms of cross-section of the housing.

In a first general approach, the housing 28 presents a cross-section (i.e. the cross-section of the housing which is transverse relative to the longitudinal direction of the cable) having an open outline.

In other words, the cross-section has extremities, as opposed to a closed outline such as a circle, which has none.

The housing 28 exhibits a concavity which defines at least part of the cavity. This concavity for instance corresponds to the bottom of the housing (in the sense of the orientation of FIG. 3). This concavity is turned towards a longitudinal region of the inner face of the sheath 26. Advantageously, this region is proximal relative to the housing. In other words, the open portion of the outline of the cross-section (which is transverse to the longitudinal direction of the cable, as shown in the Figures) of the housing is turned toward the region of the sheath from which the housing is the closest.

Figure 3:
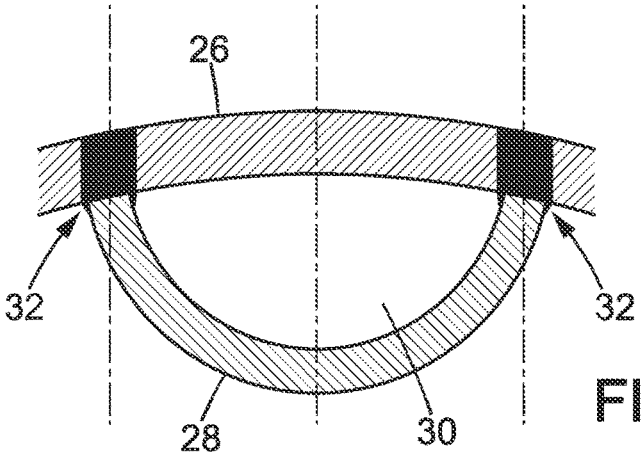
FIGS. 3 to 5 illustrate the cross-section of an embodiment of the cable according to the invention.
Figure 4:
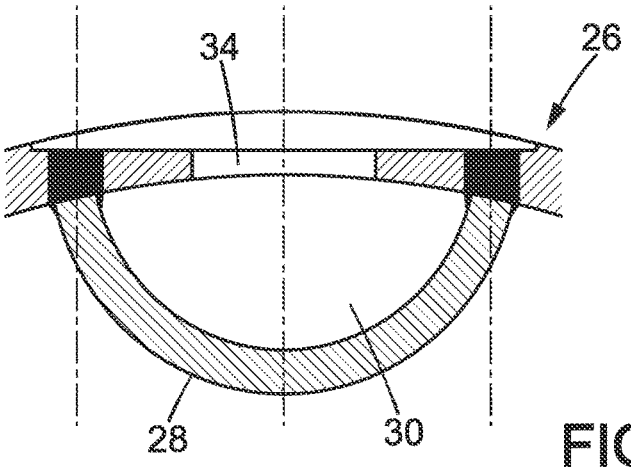
Figure 5:
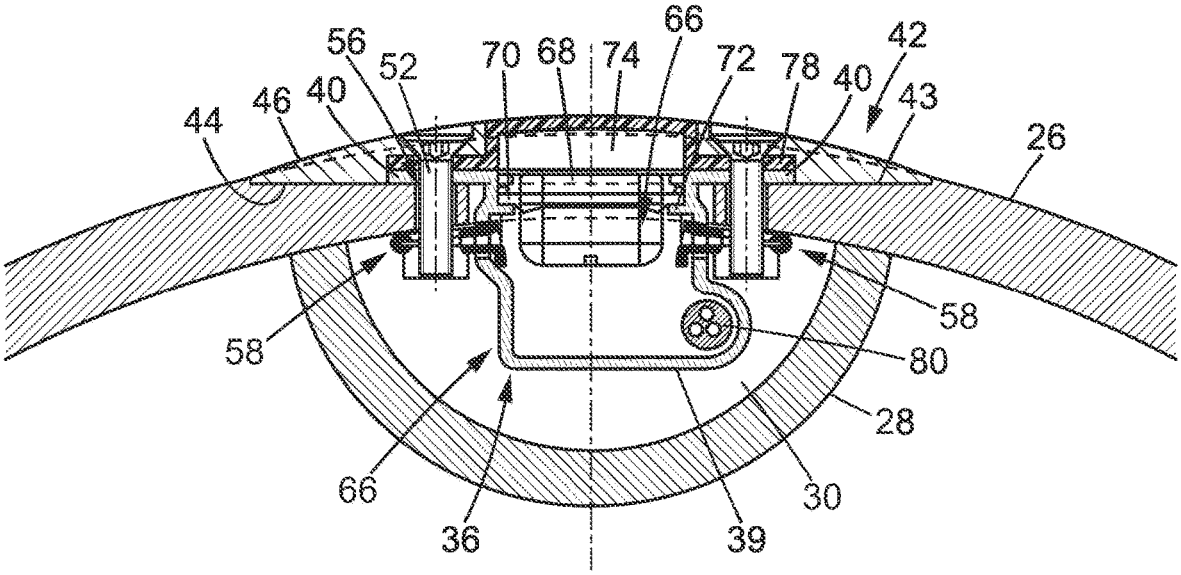

In a first embodiment illustrated in FIGS. 3 to 5, the housing 28 is advantageously secured to the sheath 26 directly.

For instance, the housing 28 is bonded to the inner face of the sheath by all or part of the edges 32 (FIG. 3) of the housing, i.e. the extremities of its cross-section. For instance, this bonding is the result of a welding process such as a plug welding process. The bonding interface of the housing may run over all or solely part of the length of the housing 28.

Alternatively, the housing is fastened to the inner face of the sheath.

In this embodiment, the cross-section of the housing 28 presents a curved shape, such as the shape of a portion of a circle.

The cavity 30 is defined between the housing 28 and the inner face of the sheath 26. In other words, the housing 28 and the sheath 26 form borders of the cavity which is thus located therebetween.

Figure 6:
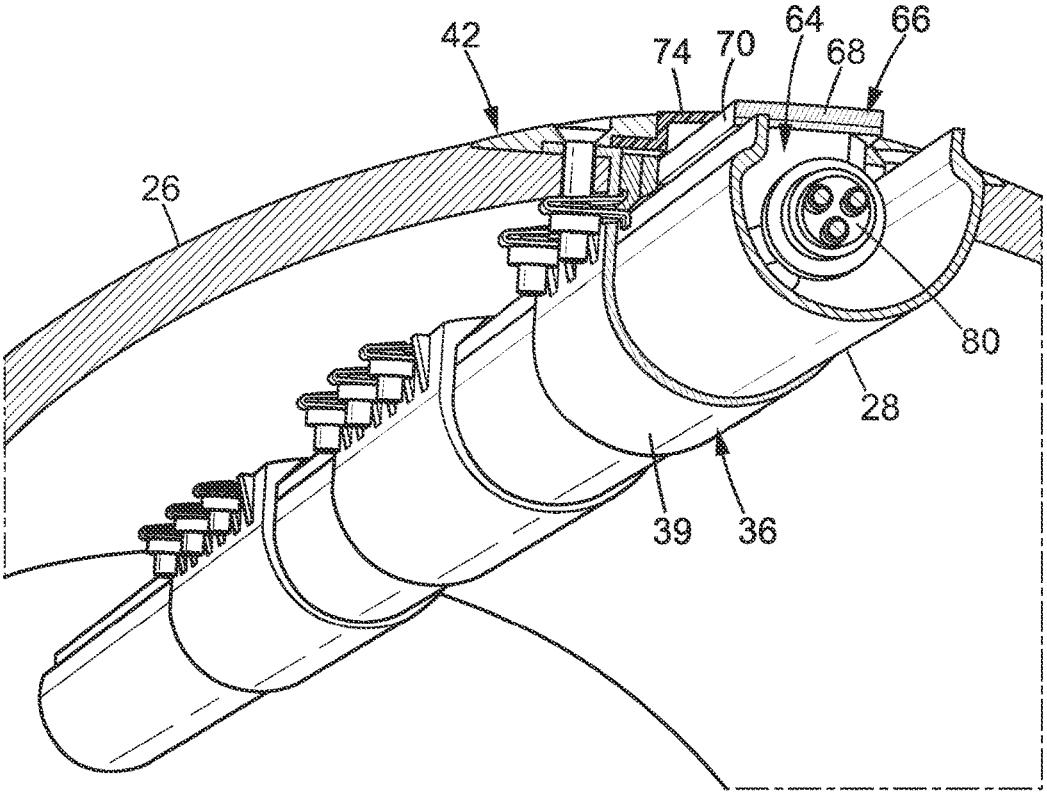
FIG. 6 illustrates a view of an embodiment of the cable according to the invention.
Figure 7:
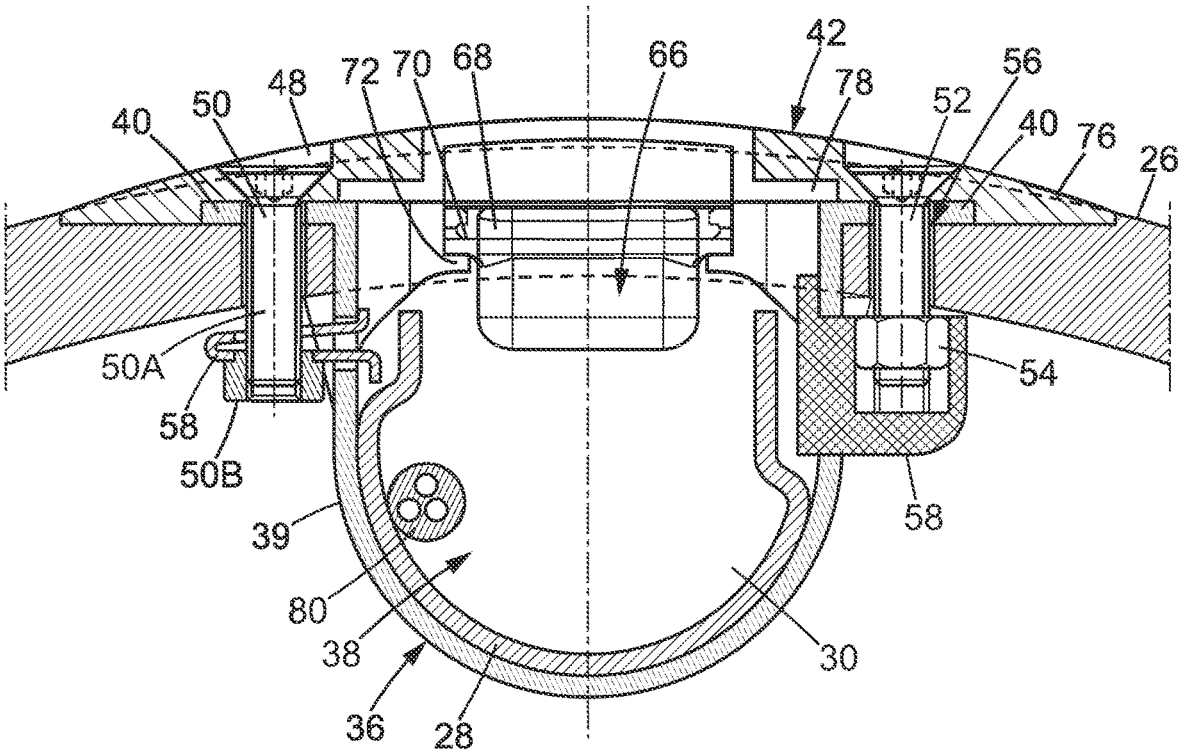
FIG. 7 illustrates a cross-section of the cable of FIG. 6.

In a second embodiment, in reference to FIGS. 6 and 7, the housing 28 is advantageously secured to the sheath 28 indirectly. In other words, the housing is secured to the sheath 26, and is at a distance from the sheath 26.

In this embodiment, the cable 10 further comprises at least one opening 34 arranged in the longitudinal region of the sheath towards which the concavity of the housing is oriented. For each opening 34, the cable 10 includes at least one reception element 36 arranged through the opening 34.

The opening 34 is arranged in the sheath 26 as a through hole. Preferentially, the sheath includes a plurality of such openings 34.

For instance, each opening 34 stretches longitudinally. For instance, they all present a same shape, such as a general rectangular or oblong shape whose long sides are disposed longitudinally relative to the cable 10. Alternatively, they may be arranged in a different manner, for instance helically or circumferentially around the sheath, although in a preferred embodiment, they stretch longitudinally, as depicted in the Figures. In addition, the openings 34 may have different respective shapes.

Advantageously, the openings 34 all have a same form and same dimensions. For instance, each opening has a length comprised between 5 cm and 50 cm. They may stretch over a greater length. For instance, in an embodiment, each opening may stretch over substantially the entirety of the corresponding sheath segment.

The width of the openings is for instance comprised between 1 cm and 10 cm.

For instance, the openings 34 are aligned longitudinally along the cable.

The openings 34 are advantageously at a distance from one another.

Advantageously, the cumulated length of the openings 34 is greater than 10% of the length of the cable.

Each reception element 36 is received in the corresponding opening 34. For instance, the reception elements 36 are received through the opening. They are then for instance inserted in the opening from outside the sheath.

Each reception element 36 presents a length (i.e. a dimension along the length of the cable) inferior or equal to that of the corresponding opening 34.

Each reception element 36 defines an inner space 38 (FIG. 7).

Advantageously, the reception elements 36 comprise a profile 39, i.e. an element having a shape generated by a cross-section of given shape, which defines interiorly the inner space 38. Such a profile may also be known as hollow structural sections.

This profile may form a main component of the reception element, which may exhibit further components such as flanges, as discussed below.

For instance, each profile presents the shape of a channel stretching longitudinally relative to the sheath 26, the channel defining the inner space 38 between its walls. The channel for instance has a general U-shaped cross-section. This cross-section may exhibit regions which result in the shape of the cross-section diverging from that of a regular U-shape as shown in FIG. 5, and are for instance designed to accommodate specific components, such as electrical cables, as discussed below.

As illustrated in FIGS. 6 and 7, advantageously, the housing 28 is received in the reception element and is nested therein. More specifically, the housing 28 is located in the inner space 38 of the profiles 39, the profile surrounding the housing 28 in order to secure the housing to the sheath 26. The housing 28 is for instance in contact with the bottom portion of the profile, whose cross-section locally presents a shape and dimensions complementary to the shape and dimensions of the portion of the housing it is in contact with.

As can be seen on FIG. 6, the housing 28 thus locally nests in the reception elements 36.

Going back to the embodiment of FIG. 5, the cable according to this embodiment advantageously also includes openings 34 and reception elements 36 received therein as described above.

However, in the context of this embodiment, the profile portion of the reception elements 36 is itself located in the cavity 30, at least in part.

Advantageously, regardless of the considered embodiment, each reception element 36 includes flanges 40 which bear on the outer surface of the sheath. For instance, the flanges 40 extend laterally from the extremities of the profile, i.e. the ends of the branches of the U-shape.

Advantageously, the cable 10 includes, for each opening 34, a cover element 42 which covers the opening 34 and the surroundings of the opening from outside the sheath.

Each cover element 42 is applied against the outer surface of the sheath 26 and is fixed relative to the sheath.

Advantageously, the region of the outer surface of the sheath 26 which surrounds a given opening 34 is configured as a flat spot 43 (FIG. 5). For instance, the flat spot 43 is rectangular in shape, and is centered on the opening.

The cover element 42 has an inner face 44 which faces the outer surface of the sheath and which has outer dimensions substantially matching that of the flat spot. The cover element 42 is in contact with the sheath so that the borders of the inner face 44 correspond to the borders of the flat spot. In other words, the cover element substantially covers the entire corresponding flat spot 43.

The inner face may be flat. Alternatively, advantageously, it is configured so as to accommodate components which might be located in the vicinity of the opening 34 on the outer surface of the sheath, such as the flanges 40.

In addition, the cover element 42 includes an outer face 46. Advantageously, the outer face 46 is curved. Advantageously, the outer face 46 has a curvature that matches the curvature of the outer surface of the sheath so that the curvature of the cross-section (relative to the longitudinal direction of the cable) of the structural cable is constant in the region of the considered opening 34 in spite of the presence of the flat spot 43.

In other words, with its configuration, the cover element 42 restores the shape of the cross-section of the cable 10 to a substantially regular configuration.

Alternatively, the curvature of the outer face 46 is slightly different from the curvature of the cross-section. For instance, the cross-section of the cable is thus not perfectly circular. For instance, the radial dimensions of the cross-section of the cable in the region of the cover element(s) are greater than that of other regions of the cable 10.

Advantageously, the flanges 40 of the reception element 36 are located between the cover element 42 and the outer surface of the sheath 40 to maintain the reception element 36 and the housing 28 in position relative to the sheath 26.

Advantageously, the cover element 42 is fastened to the sheath 26. To that end, the cover element 42 advantageously comprises reception holes 48 arranged therethrough which receive fastening means 50.

The fastening means 50 include, for each reception hole, a first and a second element 50A, 50B (FIG. 7) which cooperate with one another to fasten the cover element 42 to the sheath. One of these elements 50A, 50B is received in the corresponding reception hole 48, while the other one 50B is configured to maintain the element received in the reception hole therein. For instance, this other element is arranged inside to sheath.

For instance the first element 50A includes a screw 52 inserted in the considered reception hole 48 from outside the sheath 26, and the second element 50B includes a bolt 54 which cooperates with the screw 52. The bolt 54 is arranged inside the sheath 26.

Advantageously, the holes 48 are arranged in a region of the cover element 52 which faces the flanges 40 of the corresponding reception element 36, the reception element 36 comprising passages 56 arranged in the flanges 40 in an aligned manner with the reception holes 48, the fastening means 50 being received in the passages 56 as well, whereby the fastening means also fasten the reception element 36 to the sheath.

The elements received in the holes 48 are advantageously each maintained in a fixed position relative to the reception element 36 by a connection element 58.

The connection element 58 is for instance secured to the reception element 36. In addition, optionally, the connection element is in abutment against the inner surface of the sheath. For instance, the connection element 58 for a given reception hole 48 protrudes from a lateral wall of the reception element 36 inside the sheath 26.

The connection element 58 may have various configurations, and may for instance include a lug, a bracket or the like.

The connection element 58 and the second element 50B are for instance in contact with one another, and are in fixed relative position. For instance, the bolt 54 is in abutment with the connection element 58, which exhibits a shoulder which prevents relative sliding movements of these two objects. Alternatively, the bolt may be received in a fixed manner in a hole, such as a blind hole, of the corresponding connection element.

In a second general approach, the housing 28 has a cross-section which has a closed outline. In other words, this cross-section (relative to the longitudinal direction of the cable) has no extremity. As such, the housing presents a tubular configuration over at least part of its length.

For instance, the cross-section of the housing (transversely relative to the longitudinal direction of the cable) has any shape, such as a polygonal shape or a curved shape, such as elliptical, circular, etc. Advantageously, the cross-section has a circular shape.

Figure 8:
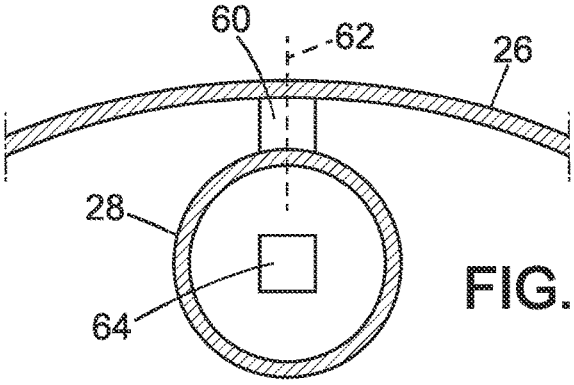
FIG. 8 illustrates another embodiment of a cable according to the invention.

In a first embodiment of this second approach, in reference to FIG. 8, the housing 28 is at a distance from the sheath 26.

Any means may be used to maintain the housing in fixed position.

For instance, the housing 28 is maintained in a fixed position relative to the sheath 26 using one or more connection module 60 which connect the housing to the sheath, which is depicted schematically in FIG. 8.

In case a plurality of connection modules 60 is used, they are for instance located at various locations along the length of the housing 28.

The connection module 60 may include one or more fastening element 62 which fastens the housing 28 to the sheath 26. The fastening elements 62 for instance include screws and bolts. For instance, the screws are arranged so as to pass through the sheath and/or the housing. Alternatively, the connection module 60 includes components such as one or more reception component which surrounds the sheath 28 in a nesting fashion which is for instance similar to that by which the reception element 36 receives the housing 28 in the embodiment of FIG. 7, the reception component being fastened to the sheath.

Figure 9:
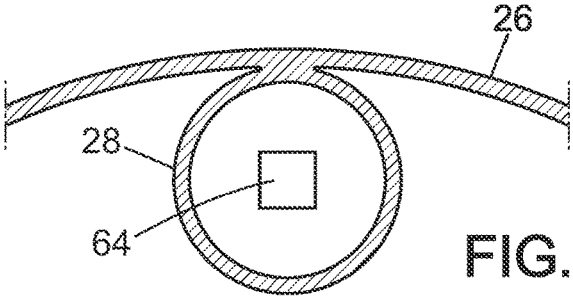
FIG. 9 illustrates another embodiment of a cable according to the invention.

In a second embodiment of this second approach, in reference to FIG. 9, the housing 28 is in contact with the sheath 26.

Advantageously, the housing 28 is then integral with the sheath 26. In other words, the housing 28 and the sheath 26 are formed together during the manufacturing process of the sheath, for instance through an extrusion or molding process, as opposed to a non-integral configuration in which the sheath 26 and the housing 28 are initially separately formed then assembled together.

Alternatively, the housing 28 and the sheath 26 are not integral with one another. For instance, in such a configuration, the housing 28 is bonded to sheath 26, for instance through a welding process.

In the context of the invention, the cavity 30 which is internally defined by the housing 28 is destined to receive all or part of at least one functional component 64 (FIG. 5) of the cable 10, as indicated above. The housing 28 forms a protective structure for such a component, in particular so as to protect the component from the tendons of the bundle.

By functional component, it is understood that the component is configured to carry out at least one function in a controlled manner By controlled manner, it is understood that the component has been placed in the cavity purposefully to produce a foreseeable result, as opposed to components which may find themselves in the cavity without being specifically intended to, such as air, dust and so on. The term "component" is merely illustrative, the functional component possibly presenting itself in the form of a plurality of elements.

Advantageously, the function is chosen among a structural function (such as a dampening, load-bearing and/or aerodynamical function), a thermal function, an electrical function and a lighting function. A given component may fulfill a plurality of such functions.

In a preferred embodiment such as that of FIGS. 2, 5, 6 and 7, the at least one functional component includes a plurality of light-radiating modules 66 (FIG. 5).

Each module 66 is configured to radiate light through at least one an opening 34 of the sheath 26 outwardly relative to the cable 10, and preferably through a single opening 34.

The modules 66 are each received in a reception element 36. A reception element 36 may receive a single module 66, or a plurality of them depending of their dimensions.

For instance, each module 66 comprises one or more light sources configured to emit light, advantageously light which is visible for the human eye. These light sources may be electroluminescent, and may include light-emitting diodes. Other principles of light emission may be used alternatively or additionally, such as luminescence, for instance phosphorescence or fluorescence.

Alternatively, the modules may not include a light source themselves, but may receive light from a light source and radiate it outwardly relative to the cable, for instance after having reflected the light or after having guided it. This light source may be distant, and either forms part of the cable or not.

However, preferably, the light-radiating modules 66 include at least one light source, and are therefore light-emitting modules for generating and emitting light outwardly through an opening 34.

The light-modules 66 are preferably implemented using the first approach wherein the housing 28 has a cross-section with an open outline.

The light-modules 66 are arranged in the cavity 30 at least in part and are fixed in position. For instance, to that end, the modules include a housing 68 which include lateral flanges 70 which cooperate with corresponding edges 72 arranged in the cable so as to maintain the housing 68 in position, at least inward radially relative to the cable.

The edges 72 are for instance arranged in the sheath 26, such as in the walls of the opening 34 (FIG. 7). Alternatively, the edges 72 are arranged in the reception element 36 (FIG. 5).

The housing 68 includes an upper face (in the sense of the orientation of FIGS. 5 and 7) which is transparent for the light emitted by the corresponding module 66. This upper face is facing away from the center of the cable 10.

It should be noted that the modules may include elements other than the housing 68 and the components located therein, such as components which extend in the cavity 30 from the housing 68.

Advantageously, the cover elements 42 include a window 74 which faces the corresponding module(s) 66. This window 74 is transparent for at least part of the light emitted by the module, so that this light passes through the window 74 to exit the cable.

Advantageously, the window 74 is arranged so as to come in contact with the upper face of the housing 68 of the module. For instance, in this configuration, the upper face of the housing is in a flush configuration relative to the outer surface of the sheath 26 (which may advantageously exhibit a flat spot).

The cover element 42 may then present itself in the form of an assembly at least of the window 74 and an outer frame 76 (FIG. 7) which surrounds the window 74 and which cooperates with the window 74 to maintain the window in position. For instance, the window 74 thus comprises side flanges 78 (FIG. 7) which are located between the sheath and the outer frame 76.

Along with the modules 66, the cavity 30 may also receive connection elements 80, such as electrical connection cable adapted to provide the modules 66 with electrical energy.

It should be noted that in addition to the elements discussed above, the modules 66 may include any further component used for their operations, such as one or more control module, one or more component configured to modify the properties of the light generated by the light sources, such as one or more lens, and so on.

Alternatively or in parallel to the modules 66, the cavity 30 may receive one or more of the following functional components:

- a circulating fluid used to carry out a thermal function;
- one or more electrical lightning protection cable;
- one or more vibration module configured to generate vibrations configured to break superficial ice or frost deposits;
- one or more dampening module configured to dampen vibrations the cable 10 is subjected to;
- one or more load-bearing component, such as a tendon or the like, configured to take up loads of the cable, in particular so as to minimize the sag of the catenary shape of the cable 10;
- one or more heating module and related electrical supply components.

Regarding the circulating fluid, it is advantageously set in motion in the cavity 30 using one or more pump, for instance located at an extremity of the housing 28. One or more additional pump may be housed directly in the housing along the path of the housing.

The fluid may be a gas, such as air, and may be heated or cooled. The gas may be dried or not. Alternatively, it may be a liquid. For instance, it may be ethylene glycol.

The fluid is configured to heat or cool the cable. For instance, it is configured to prevent the formation of frost and/or ice on and/or in the cable and/or to remove such frost and/or ice, or to cool the cable.

The fluid may circulate directly in the housing, or may circulate in a conduit located in the cavity. The housing 28 may present orifices for the fluid to pass through, for instance to as to allow guidance of the fluid to have the latter come in contact with the outer surface and/or the inner surface of the sheath 26.

Regarding the lightning protection cable, it may be associated (i.e. electrically connected) to one or more lightning rods which are designed to attract lightning bolts, as well as sacrificial components configured to react with the electrical energy resulting from the lightning bolts to dissipate the later. The sacrificial components and the rods are for instance located outside the sheath at various locations, and are for instance secured to the outer surface of the sheath.

Regarding the vibration modules, they may include a vibration engine configured to generate vibrations having one or more chosen frequencies, such as vibrations having a frequency having an order of magnitude several tens of hertz.

Regarding the dampening modules, also referred to as damping modules, they may include linear dissipation components which are arranged so as to stretch longitudinally along the cavity. For instance, these components include dissipative cables, such as cables including a plurality of one or more string made of textile or elastomeric material. Alternatively or in parallel, the dampening module may include dissipating components arranged at the junction between segments of the sheath.

Regarding the load-bearing component(s), it is configured to support the cable itself to reduce its sag, rather than to the support the structure 12. Advantageously, it has properties which diverge from that of the tendons of the bundle, in particular at least in term of elasticity. For instance, it is thus more flexible (in terms of axial stiffness) so as to minimize its tension variations under load variations in the tendons of the cable itself.

Regarding the heating module, it may include a resistive component configured to generate heat by Joule effect. Optionally, the heating module includes a component configured to spread the generated heat in the vicinity of the heating module.

Except for circulating fluid, the components 64 arranged in the cavity 30 are preferably maintained in a fixed position relative to the housing 28. For instance, they are secured to the later using any known means.

Other embodiments of the invention may be envisaged. In particular, in some embodiments, the embodiments above may be combined together when technically possible. For instance, the housing and/or the sheath may present a first configuration among those above over part of their length, a second configuration over another part of their length, and so on.

For instance, the housing 28 is nested in reception elements 36 over a first portion, receives other reception elements over another portion, is bonded to the sheath on another portion, and so on. Any such combination is thus specifically envisaged.

Moreover, the openings 34 have essentially been disclosed in reference to light-modules. However, they may be used without such modules 66, and may then receive reception elements 36 or not. They may then have any shape and dimensions. In any case, advantageously, the openings 34 are arranged in a longitudinal region of the sheath towards which the opening (or one of such openings) of the outline of the cross-section of the housing is directed.

In addition, the invention is applicable to structural cables other than stay cables.

It should be noted that the above applications of the invention may be carried out separately, i.e. that the cavity may house all or part of one or more functional component of a single type chosen for instance among those listed above.

The cavity may then be implemented in any form as described above depending on the considered application.

The invention may also be implemented so as to have different types of functional components housed simultaneously at least in part in the housing.

Moreover, in case the cable 10 includes a plurality of housings, for instance spread circumferentially within the sheath, the housings may exhibit identical or different configurations.

Moreover, the various housings may house identical components or different components.

In an example, the cable 10 includes a plurality of housings which stretch over a common portion of the length of the cable and which are circumferentially spread in the sheath over this portion. A plurality of these housings include light-radiating modules 66 as described above.

The invention claimed is:

1. A structural cable of a construction work, the structural cable comprising:

a bundle of load-bearing tendons;

a sheath within which the bundle of tendons is located;

a housing within the sheath and fixed relative to the sheath, said housing having a concavity turned towards a longitudinal region of the sheath which includes openings, to define a cavity, extending longitudinally relative to the sheath, wherein the bundle of tendons is located outside the housing and the cavity.

2. The structural cable of claim 1, wherein the housing extends over at least 10% of the length of the structural cable.

3. The structural cable of claim 1, wherein the housing is bonded to an inner surface of the sheath.

4. The structural cable of claim 1, wherein the housing comprises a plurality of longitudinal segments aligned with one another along the length of the structural cable.

5. The structural cable of claim 1, wherein the housing is substantially continuous longitudinally relative to the sheath.

6. The structural cable of claim 1, further comprising:

at least one functional component arranged in said cavity.

7. The structural cable of claim 6, wherein the at least one functional component comprises a fluid put in circulation in the housing, said fluid being configured to carry out a thermal function of the structural cable.

8. The structural cable of claim 6, wherein the at least one functional component comprises at least one damping module configured to dissipate vibrations of the structural cable.

9. The structural cable of claim 6, wherein the at least one functional component includes a plurality of light-radiating modules configured to radiate light each arranged at least in part in said cavity so as to radiate light through at least one of said openings outwardly relative to the structural cable.

10. The structural cable of claim 9, further comprising:

for each opening among a plurality of openings, at least one reception element arranged in said opening, at least one light-radiating module being received within said reception element.

11. The structural cable of claim 10, wherein the reception element is secured to the sheath, the reception element receiving at least one light-radiating module, the housing being held in said reception element.

12. The structural cable of claim 11, further comprising:

a cover element arranged on the outer surface of the sheath, wherein the reception element further comprises:

a flange arranged between the cover element and the outer surface of the sheath to maintain the reception element in position.

13. The structural cable of claim 12, wherein the cover element includes reception holes receiving fastening elements which fasten the housing and the cover element to the sheath.

14. The structural cable of claim 12, wherein for at least one opening, the outer surface of the sheath defines a flat spot surrounding said opening, the cover element having a flat inner face whose dimensions correspond to the dimensions of the flat spot.

15. The structural cable of claim 14, wherein the cover element has a curved outer face whose curvature matches the curvature of the outer surface of the sheath so that the curvature of the cross-section of the structural cable is substantially constant in the region of the opening.

16. The structural cable according to claim 6, wherein the at least one functional component includes a lightning protection cable.

17. The structural cable according to claim 16, wherein the structural cable further comprises at least one lightning rod and at least one sacrificial module electrically connected to the lightning protection cable and respectively configured to attract lightning bolts and dissipate energy resulting from said lightning bolts.

* * * * *